US009745525B2

(12) United States Patent
Chornet et al.

(10) Patent No.: US 9,745,525 B2
(45) Date of Patent: Aug. 29, 2017

(54) TREATMENT OF HEAVY OILS TO REDUCE OLEFIN CONTENT

(71) Applicants: Michel Chornet, Sherwood Park (CA); Christos Chronopoulos, Sherbrooke (CA); Soumaine Dehkissia, Sherbrooke (CA)

(72) Inventors: Michel Chornet, Sherwood Park (CA); Christos Chronopoulos, Sherbrooke (CA); Soumaine Dehkissia, Sherbrooke (CA)

(73) Assignee: Fractal Systems, Inc., Sherbrooke, Quebec (CA)

( * ) Notice: Subject to any disclaimer, the term of this patent is extended or adjusted under 35 U.S.C. 154(b) by 60 days.

(21) Appl. No.: 14/454,001

(22) Filed: Aug. 7, 2014

(65) Prior Publication Data

US 2015/0060333 A1 Mar. 5, 2015

Related U.S. Application Data

(60) Provisional application No. 61/864,827, filed on Aug. 12, 2013.

(51) Int. Cl.
*B01J 8/16* (2006.01)
*C10G 7/00* (2006.01)
(Continued)

(52) U.S. Cl.
CPC ..... *C10G 55/04* (2013.01); *C10G 7/00* (2013.01); *C10G 9/007* (2013.01); *C10G 15/00* (2013.01);
(Continued)

(58) Field of Classification Search
CPC .... C10G 9/007; C10G 7/00; B01J 8/16; B01J 19/008
See application file for complete search history.

(56) References Cited

U.S. PATENT DOCUMENTS 5,096,566 A * 3/1992 Dawson ..... C10G 9/007 208/106
7,491,314 B2 2/2009 Van Den Bosch et al.
(Continued)

FOREIGN PATENT DOCUMENTS

CA 2195165 7/1997

OTHER PUBLICATIONS

Park, S.H. et al. (2008). Energy & Fuels, 22, 605-613.*
Doraiswamy, L.K. (2001). Organic Synthesis Engineering, Oxford University Press, 936 pgs (Office action cites p. 740).*

*Primary Examiner* — Brian McCaig
(74) *Attorney, Agent, or Firm* — Raymond J. Lillie

(57) ABSTRACT

A process for treating heavy oil to provide a treated heavy oil having a reduced density and viscosity, as well as an olefin content that does not exceed 1.0 wt. %. The process comprises separating the initial heavy oil into a first fraction, which in general contains lower-boiling components, and a second fraction. The second fraction comprises a heavy oil having a p-value of at least 5% greater than the p-value of the initial heavy oil prior to separating the initial heavy oil into the first fraction and the second fraction, and the second fraction has an aromaticity that is no more than 5% less than the aromaticity of the initial heavy oil prior to separating the initial heavy oil into the first fraction and the second fraction. The second fraction then is upgraded to reduce the density and viscosity of the heavy oil. After the second fraction is upgraded, it is recombined with at least a portion of the first fraction to provide a treated heavy oil having an olefin content that does not exceed 1.0 wt. %. The separation of the initial heavy oil into first and second fractions enables one to achieve improved reduction of the density and viscosity of the treated heavy oil while maintaining the olefin content at an acceptable level.

67 Claims, 3 Drawing Sheets

(51) Int. Cl.

| | |
|---|---|
| ***C10G 55/04*** | (2006.01) |
| ***C10G 67/02*** | (2006.01) |
| ***C10G 55/02*** | (2006.01) |
| ***C10G 9/00*** | (2006.01) |
| ***C10G 15/00*** | (2006.01) |
| ***C10G 15/10*** | (2006.01) |
| ***C10G 15/08*** | (2006.01) |

(52) U.S. Cl.

CPC ..... *C10G 15/08* (2013.01); *C10G 15/10* (2013.01); *C10G 55/02* (2013.01); *C10G 67/02* (2013.01); *C10G 2300/302* (2013.01); *C10G 2300/308* (2013.01)

(56) References Cited

U.S. PATENT DOCUMENTS

| | | | |
|---|---|---|---|
| 7,943,035 | B2 | 5/2011 | Chornet et al. |
| 8,105,480 | B2 | 1/2012 | Chornet et al. |
| 2013/0015100 | A1 | 1/2013 | Pereira-Almao et al. |

* cited by examiner

TREATMENT OF HEAVY OILS TO REDUCE OLEFIN CONTENT

This application claims priority based on provisional Application Ser. No. 61/864,827, filed Aug. 12, 2013, the contents of which are incorporated by reference in their entirety.

This invention relates to the treatment of heavy oils to achieve improved reduction of the density and viscosity of the heavy oils, while maintaining the olefin content of the heavy oils at acceptable levels. More particularly, this invention relates to treating a heavy oil by separating the heavy oil into a first, or lower-boiling range, or light, fraction, and a second, or higher-boiling range, or heavy, fraction. The second, or heavy, fraction is upgraded, such as by thermal (e.g., visbreaking), mechanical (e.g., hydrodynamic and/or ultrasonic cavitation), oxydesulfurization and/or other upgrading processes in order to reduce its density and viscosity. After upgrading, it is recombined with at least a portion of the first fraction to provide a treated heavy oil having an olefin content that does not exceed 1.0 wt. %.

The term "heavy oil", as used herein, includes oils which are classified by the American Petroleum Institute (API), as heavy oils or extra heavy oils, as well as blended oils, such as dilbit (a diluent-bitumen blend) or synbit (a synthetic oil-bitumen blend). In general, a heavy hydrocarbon oil has an API gravity between 22.3° (density of 920 kg/m$^3$ or 0.920 g/cm$^3$) and 10.0° (density of 1,000 kg/m$^3$ or 1 g/cm$^3$). An extra heavy oil in general has an API gravity of less than 10.0° (density greater than 1,000 kg/m$^3$ or greater than 1 g/cm$^3$). For example, heavy oils may be extracted from oil sands, atmospheric tar bottoms products, vacuum tar bottoms products, shale oils, coal-derived liquids, crude oil residues, and topped crude oils.

Heavy oils in general have macro and micro structural properties as well as having specific chemical constitutive molecules. The chemical constitutive molecules belong to two generic categories, maltenes and asphaltenes. Maltenes are soluble in pentane or light saturated hydrocarbons, while asphaltenes are soluble in toluene but insoluble in pentane or light saturated hydrocarbons. Also present in the heavy oils are metals, particularly nickel and vanadium. The metals are associated mainly with the asphaltenes. The spatial organization of maltenes and asphaltenes results in the macro and micro structural properties, with the molecular organization causing the high viscosities, which pose a problem in transporting such oils, and in separating the asphaltenes from the maltenes.

More particularly, the asphaltenes are formed by a core of polynuclear aromatic molecules grouped in layers, to which alkyl chains are attached. The core is surrounded by and immersed in the maltene material. The maltene material includes free saturates (some of them cyclic), mono- and diaromatics, polyaromatics, and polar components or resins which are believed to be associated closely with the asphaltenes. This organization is considered to be the microstructure and the core of the asphaltenes can be considered as possessing microcrystalline arrangements. The microstructural organization forms aggregates in which several microcrystalline arrangements form a micellar structure known as a macrostructure. The micellar structure or macrostructure has strong associative and cohesive forces between the aggregates, which accounts for the high viscosity of the heavy oil.

Heavy oils may be upgraded in order to decrease their density and viscosity, thus making the heavy oil more pumpable and transportable. Such upgrading may include thermal processes, mechanical processes, such as hydrodynamic and/or ultrasonic cavitation, or a combination of thermal and mechanical processes, and/or hydrogen addition processes, and/or oxydesulfurization.

Such upgrading of the heavy oil, however, may result in the formation of undesirable amounts of olefins or unsaturated compounds, also known as alkenes. The term "olefin", as used herein, means any unsaturated hydrocarbon containing one or more pairs of carbon atoms linked by a double bond. Olefins may decrease the stability of the heavy oil, and/or may create problems during transportation and refining. In addition, olefins and aromatics are precursors of coke formation.

Thus, it is desired to reduce the density and viscosity of a heavy oil as much as possible, while preventing the formation of an unacceptable amount or level of olefins. Such a heavy oil also will have desired stability, and a desired aromaticity, and will have improved pumpability and transportability.

Olefin content can be measured by the bromine number test or by the proton Nuclear Magnetic Resonance Spectroscopy (HNMR) test. The bromine number is the amount of bromine (in grams) absorbed by 100 grams of a sample. The bromine number is measured according to the ASTM-D1159 procedure. The number indicates the degree of unsaturation, which is related to olefin content. A bromine number under 10 is considered acceptable for normal crude oil handling. The HNMR test measures olefin content on the full crude by mass as 1-decene equivalent. A test result that is greater than 1.0% olefin by mass as 1-decene equivalent indicates the presence of an unacceptable amount of olefins. A bromine number of 10 corresponds generally and approximately to an olefin content of 1.0% by weight. With respect to the transportation of heavy oils, the olefin content of the heavy oil should not exceed 1.0% by weight, as measured by HNMR or bromine number.

The p-value of a heavy oil is a measure of the flocculation potential of asphaltenes and their tendency to form solid deposits. The p-value is a stability indicator and also is a measure of asphaltene solubility. The p-value is determined by testing the heavy oil according to the ASTM-D7157 method or a method similar to ASTM D-7157, and ranges from 1 (unstable) to 5 (very stable). The method consists of solubilizing three samples of the heavy oil using different amounts of toluene or xylenes. These three different mixtures of heavy oil samples and aromatic solvent (i.e., toluene or xylene) then are titrated with a paraffinic solvent, such as n-heptane, to precipitate the asphaltenes. The amounts of heavy oil and solvents added, including the titration solvent, up to the onset of the peptization of the asphaltenes, are used to calculate the stability parameters and their intrinsic stability. A p-value which is at least 1.5 indicates that the heavy oil is stable, while a heavy oil having a p-value of less than 1.5 generally is considered unstable.

Aromaticity is measured using a carbon-13 NMR (or $^{13}$C NMR or carbon NMR) test. In this test, nuclear magnetic resonance (NMR) is applied to carbon. This test is analogous to proton NMR (1H NMR) testing and allows the identification among others of aromatic carbon atoms in an organic molecule just as proton NMR testing identifies hydrogen atoms. By using $^{13}$C NMR, one can determine the level of aromaticity in a heavy oil.

Applicants have discovered that, by removing aliphatic or paraffinic components that are concentrated in the lighter fractions of a heavy oil prior to upgrading the heavy oil, the solubility of the asphaltenes is increased (as shown by the observed increase in the p-value), which in turn reduces the formation of olefins during upgrading of the heavy oil, such as by thermal treatment, mechanical treatment (e.g., hydrodynamic and/or ultrasonic cavitation), oxydesulfurization, and/or hydrogen addition processes, to reduce the density and viscosity of the heavy oil.

Therefore, by removing such aliphatic or paraffinic components that are contained in the lighter fractions of the heavy oil prior to upgrading the heavy oil, Applicants have achieved through a subsequent upgrading process improved reduction of the density and viscosity of the heavy oil while maintaining the olefin content at acceptable levels.

Thus, in accordance with an aspect of the present invention, there is provided a process for treating a heavy oil to provide a treated heavy oil having a reduced density and viscosity and an olefin content that does not exceed 1.0 wt. %. The process comprises a pre-treatment which comprises separating the initial heavy oil into a first fraction and a second fraction. The second fraction comprises a heavy oil having a p-value of at least 5% greater than the p-value of the initial heavy oil prior to separating the initial heavy oil into the first fraction and the second fraction. The second fraction also has an aromaticity that is no more than 5% less than the aromaticity of the initial heavy oil prior to separating the initial heavy oil into the first fraction and the second fraction. The density and viscosity of the second fraction then are reduced. The second fraction then is combined or reblended with at least a portion of the first fraction to provide a treated heavy oil having an olefin content that does not exceed 1.0 wt. %.

Although the scope of the present invention is not to be limited to any theoretical reasoning, it is believed that when the initial heavy oil is separated into a first fraction and a second fraction as hereinabove described, the first fraction, in general, contains low-boiling components such as aliphatic or paraffinic components which, if not separated from the heavy oil, may result in the formation of olefins when the heavy oil is subjected to upgrading to reduce the density and viscosity of the heavy oil. By removing these components prior to upgrading the heavy oil, the solubility of the asphaltenes is increased, and one achieves improved reduction of the density and viscosity of the heavy oil while the possibility of the formation of unacceptable levels of olefin is reduced, and the resulting upgraded heavy oil is more pumpable and transportable, while further density and viscosity reductions are possible with respect to a given threshold level of olefin.

In general, the initial heavy oil is separated into a first fraction and a second fraction by flashing, boiling, distilling, or fractionating the heavy oil. In a non-limiting embodiment, the first fraction has a boiling range that does not exceed 450° C., i.e., none of the components in the first fraction boils at a temperature that exceeds 450° C. In another non-limiting embodiment, the first fraction has a boiling range that does not exceed 325° C. In yet another non-limiting embodiment, the first fraction has a boiling range that does not exceed 250° C. In a further non-limiting embodiment, the first fraction has a boiling range that does not exceed 180° C. In another non-limiting embodiment, the first fraction has a boiling range that does not exceed 150° C.

In a non-limiting embodiment, the second fraction has a p-value which is at least 10% greater than the p-value of the initial heavy oil prior to separating the initial heavy oil into the first fraction and the second fraction. In another non-limiting embodiment, the second fraction has a p-value which is at least 15% greater than the p-value of the initial heavy oil prior to separating the initial heavy oil into the first fraction and the second fraction. In yet another non-limiting embodiment, the second fraction has a p-value which is at least 25% greater than the p-value of the initial heavy oil prior to separating the initial heavy oil into the first fraction and the second fraction.

In a non-limiting embodiment, the second fraction has an aromaticity that is no more than 3% less than the aromaticity of the initial heavy oil prior to separating the initial heavy oil in the first fraction and the second fraction. In another non-limiting embodiment, the second fraction has an aromaticity that is at least 3% greater than the aromaticity of the initial heavy oil prior to the separation of the initial heavy oil into the first fraction and the second fraction. In yet another non-limiting embodiment, the second fraction has an aromaticity that is at least 5% greater than the aromaticity of the initial heavy oil prior to the separation of the initial heavy oil into the first fraction and the second fraction.

After the initial heavy oil is separated into the first fraction and the second fraction, the second fraction then is treated further to reduce the density and viscosity of the second fraction, thereby making the second fraction more pumpable and transportable. Such treatment includes, but is not limited to, subjecting the second fraction to thermal treatment by heating the second fraction and/or subjecting the second fraction to mechanical upgrading such as hydrodynamic and/or ultrasonic cavitation and/or other upgrading technologies, such as hydrogen addition processes, including using hydrogen donors, pure hydrogen, and/or synthesis gas. Because the first fraction has been separated from the second fraction prior to the upgrading of the second fraction, one achieves improved reduction of the density and viscosity of the second fraction while maintaining the olefin content of the second fraction at acceptable levels.

In a non-limiting embodiment, the second fraction is subjected to thermal treatment, such as visbreaking, by heating the second fraction to a temperature of from about 200° C. to about 600° C., thereby reducing the density and viscosity of the second fraction. In another non-limiting embodiment, the second fraction is treated thermally by heating to a temperature of from about 350° C. to about 450° C. In yet another non-limiting embodiment, the second fraction is treated thermally by heating to a temperature of from about 380° C. to about 420° C.

In a non-limiting embodiment, the second fraction is subjected to the hereinabove described thermal treatment, such as visbreaking, for a period of time of from about 1 minute to about 20 minutes. In another non-limiting embodiment, the second fraction is subjected to the above-mentioned thermal treatment for a period of time of from about 3 minutes to about 8 minutes.

In another non-limiting embodiment, the second fraction is heated to a temperature of from about 200° C. to about 600° C., and then subjected to hydrodynamic cavitation, thereby reducing the density and viscosity of the second fraction. In another non-limiting embodiment, the second fraction is heated to a temperature of from about 350° C. to about 450° C., and then is subjected to hydrodynamic cavitation to reduce the density and viscosity of the second fraction. In yet another non-limiting embodiment, the second fraction is heated to a temperature of from about 380° C. to about 420° C., and then is subjected to hydrodynamic cavitation to reduce the density and viscosity of the second fraction.

In another non-limiting embodiment, the second fraction is subjected to hydrodynamic cavitation by passing the second fraction from a conduit into a cavitation zone, which is in the form of a restriction or nozzle. In general, the ratio of the width of the cavitation zone to the width of the conduit is from about 1/230 to about 1/75. The ratio of the length of the cavitation zone to the width of the cavitation zone, in general, is from about 10 to about 125. In another non-limiting embodiment, the ratio of the length of the cavitation zone to the width of the cavitation zone is from about 50 to about 125.

In a non-limiting embodiment, the second fraction is passed through the cavitation zone, which may be in the form of a capillary or nozzle or other type of restriction, at a velocity of from about 100 m/sec to about 300 m/sec, and as the second fraction passes through the cavitation zone such as a capillary or nozzle, the second fraction is subjected to a pressure drop of from about 150 psig to about 5,000 psig. In the cavitation zone, the second fraction is subjected to cavitation. As known in the art, cavitation is produced by microbubbles of gas dispersed in the second fraction. Such microbubbles expand and then implode or collapse. The implosion or collapse of the microbubbles raises the temperature at the interface of the microbubbles and second fraction to very high levels, for example, from about 1,000° C. to about 2,000° C., for a period of microseconds, which facilitates free radical formation and chemical reactions.

In a non-limiting embodiment, the second fraction is passed through the cavitation zone at a velocity of from about 150 m/sec to about 300 m/sec. In another embodiment, the second fraction is passed through the cavitation zone at a velocity of from about 200 m/sec to about 300 m/sec.

In a non-limiting embodiment, the second fraction is subjected to a pressure drop in the cavitation zone of from about 400 psig to about 4,000 psig.

In another non-limiting embodiment, the second fraction is subjected to a pressure drop in the cavitation zone of from about 1,500 psig to about 3,500 psig.

Examples of hydrodynamic cavitation apparatuses having cavitation zones that may be used in the present invention are disclosed in U.S. Pat. Nos. 7,943,035 and 8,105,480, the contents of which are incorporated by reference in their entireties.

Thus, in a non-limiting embodiment, the second fraction, which has a p-value of at least 5% greater than the p-value of the initial heavy oil prior to separating the initial heavy oil into the first fraction and the second fraction, and an aromaticity that is no more than 5% less than the aromaticity of the initial heavy oil prior to separating the initial heavy oil into the first fraction and the second fraction, is heated to a temperature of from about 385° C. to about 420° C., whereby a portion of the second fraction becomes a vapor, and then is passed from a conduit through a hydrodynamic cavitation zone at a velocity of from about 100 m/sec to about 300 m/sec, and at a pressure drop of from about 150 psig to about 5,000 psig, and wherein the ratio of the width of the cavitation zone to the width of the conduit is from about 1/230 to about 1/75, and the ratio of the length of the cavitation zone to the width of the cavitation zone is from about 10 to about 125. The second fraction is subjected to hydrodynamic cavitation for a period of time which in general does not exceed 10 seconds.

Because certain components, such as aliphatic and paraffinic compounds, were separated from the second fraction prior to subjecting the second fraction to the above-mentioned thermal treatment and hydrodynamic cavitation, one obtains improved or further reduction of the density and viscosity of the second fraction, while unacceptable levels of olefins are not produced as a result of such thermal treatment and cavitation. That is, the removal of the lighter ends permits reaching a given threshold level of olefins with greater density and viscosity upgrades when using thermal treatment, and/or cavitation and/or other upgrading technologies.

In a non-limiting embodiment, after the second fraction is subjected to heating and/or cavitation to reduce the density and viscosity of the second fraction, the second fraction may be subjected to further treatment to remove undesired components, such as naphtha and hydrogen sulfide, therefrom.

After the second fraction is heated and/or subjected to cavitation to reduce the density and viscosity thereof, the second fraction is recombined with at least a portion of the first fraction, which boils at a temperature that does not exceed 450° C. In a non-limiting embodiment, at least 50 wt. % of the first fraction is recombined with the stable heavy oil. The resulting combined heavy oil stream, which has an olefin content that does not exceed 1.0 wt. %, then is transported for further processing.

The invention now will be described with respect to the drawings, wherein.

Figure 4:
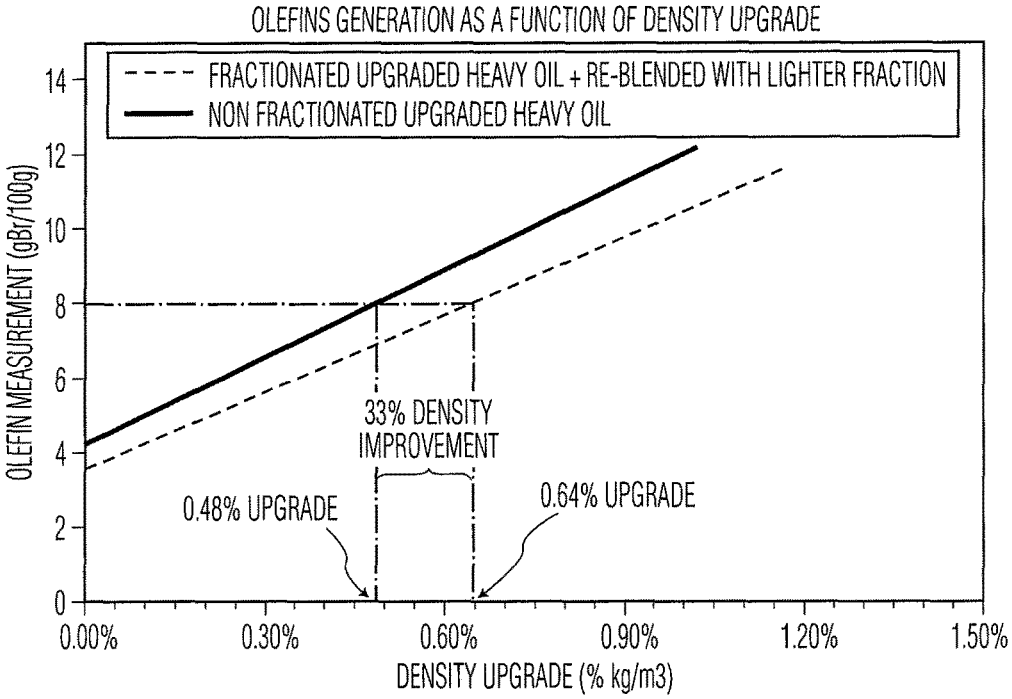
Figure 5:
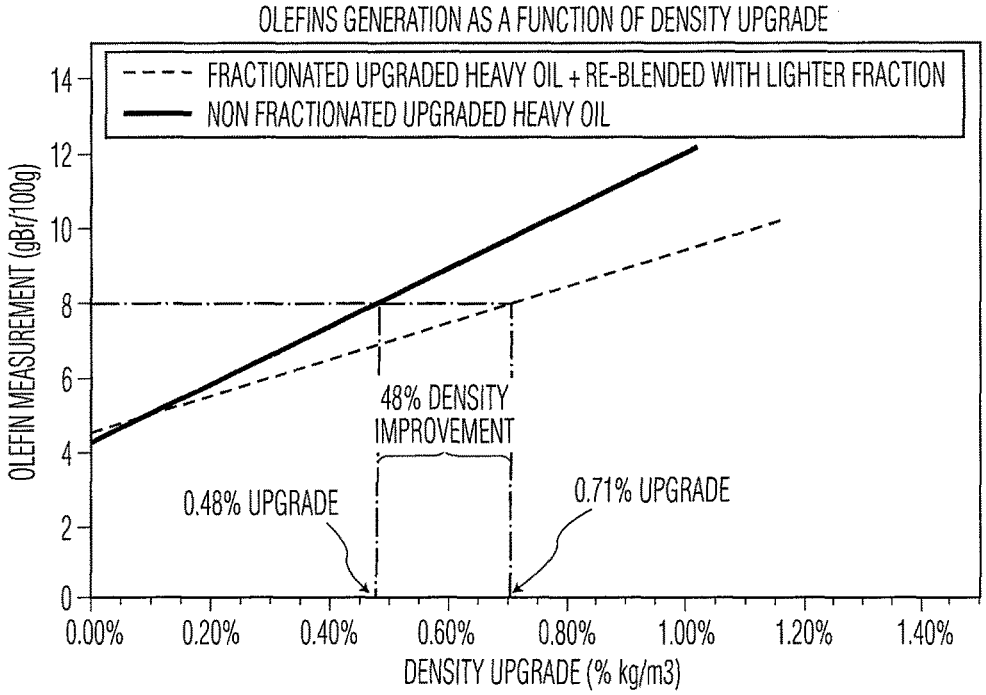

FIG. 4 is a graph showing density upgrade (% kg/m$^3$) versus olefin measurement (g$Br_2$/100 g) of an upgraded heavy oil that was fractionated to remove a 180° C.$^-$ fraction prior to upgrading, following by reblending with the 180° C.$^-$ fraction, compared to a non-fractionated heavy oil; and FIG. 5 is a graph showing density upgrade (% kg/m$^3$) versus olefin measurement (g$Br_2$/100 g) of an upgraded heavy oil that was fractionated to remove a 325° C.$^-$ fraction prior to upgrading, followed by reblending with the 325° C.$^-$ fraction, compared to a non-fractionated heavy oil.

Figure 1:
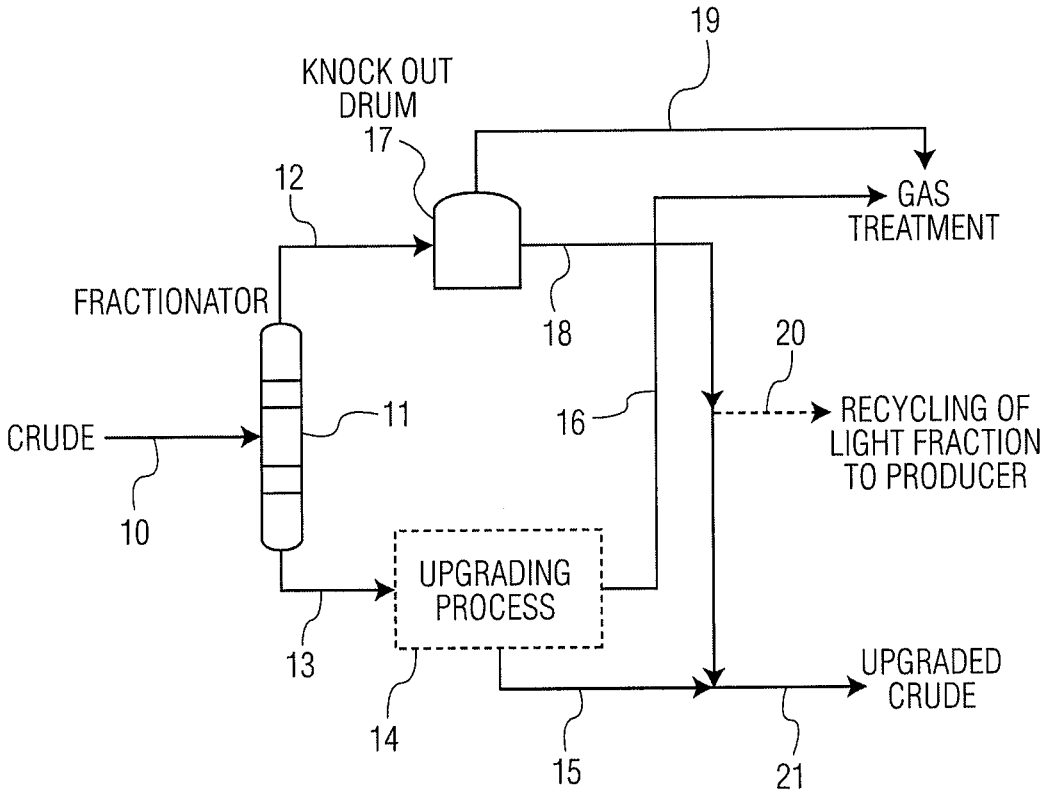
FIG. 1 is a schematic of an embodiment of the method for treating a heavy oil in accordance with the present invention.

Referring now to FIG. 1, an initial heavy oil in line 10 is pumped and heated and sent to fractionator 11. Fractionator 11 is operated under conditions such that the heavy oil is separated into two fractions, i.e., a first fraction and a second fraction. In general, the first fraction is a lower-boiling fraction that includes light components such as diluents, water vapor, aliphatic hydrocarbons, and paraffinic hydrocarbons. The second fraction is a heavy oil that has a p-value that is at least 5% greater than the p-value of the initial heavy oil prior to the separation of the initial heavy oil into the first fraction and the second fraction, and has an aromaticity that is no more than 5% less than the aromaticity of the initial heavy oil prior to the separation of the initial heavy oil into the first fraction and the second fraction. In general, fractionator 11 is operated at a temperature of no more than 450° C. Thus, the first fraction boils at a temperature that does not exceed 450° C. Fractionator 11 may be operated, in non-limiting embodiments, at temperatures that exceed slightly, for example, boiling points of 325° C., 250° C., 180° C., or 150° C., thereby providing first fractions that boil at temperatures that do not exceed 325° C., 250° C., 180° C., and 150° C., respectively.

The first fraction, including the lower-boiling compounds, or light components, is withdrawn from fractionator 11 through line 12 and passed to knock-out drum 17. Off gases are withdrawn from knock-out drum 17 through line 19, while the remainder of the first, or light, fraction is withdrawn from knock-out drum 17 through line 18. Thus, a fraction that has low-boiling point, or that has light, components is separated from the second fraction, whereby the second fraction is a heavy oil that contains a minimal amount of components that may not be converted easily to olefins during further upgrading of the second fraction.

The second fraction is withdrawn from fractionator 11 through line 13 and subjected to further upgrading to reduce the density and viscosity of the heavy oil, schematically indicated as 14. For example, the second fraction may be subjected to thermal treatment at a temperature of about 200° C. to about 600° C. for a period of time of from about 1 minute to about 20 minutes, and then subjected to hydrodynamic cavitation by passing the second fraction through a restriction or nozzle such as those hereinabove described and at a velocity and pressure as hereinabove described. It is to be understood, however, that the scope of the present invention is not to be limited to any specific upgrading processes for reducing the density and viscosity of the second fraction.

After the second fraction is upgraded, incondensable gases or off gases are withdrawn from upgrading zone 14 through line 16, while the remainder of the second fraction, which is a heavy oil having a reduced density and viscosity, is withdrawn from upgrading zone 14 through line 15.

The light fraction in line 18 then is passed to line 15, whereby the first, or light, fraction is recombined with the second fraction. Prior to being passed to line 15, a portion of the light fraction may be withdrawn from line 18 through line 20.

The recombination of at least a portion of the light fraction from line 18 with the second fraction in line 15 provides a combined heavy oil stream in line 21 that has an olefin content that does not exceed 1.0 wt. %, and has a reduced density and viscosity, whereby such oil is pumpable and transportable, and can be subjected to further processing, such as refining.

EXAMPLES

The invention now will be described with respect to the following examples; however, the scope of the present invention is not intended to be limited thereby.

Example 1

A heavy oil having a p-value of 3.20 and an aromaticity of 31% is distilled such that fractions having boiling points of 180° C., 250° C., or 325° C. were removed. The recovered volumes, in percent, of the fractions removed by distillation, and the p-values and aromaticity increases for the remaining heavy oils, are measured for each fraction. The results are shown in Table 1 below.

TABLE 1

| Distillation Temperature (° C.) | Recovered Volume (%) | P-value | P-value increase (%) | Aromaticity | Aromaticity Increase (%) |
|---|---|---|---|---|---|
| Undistilled | 0.0% | 3.20 | 0.0% | 31% | 0.0% |
| 180 | 13.0% | 3.57 | 11.6% | 32% | 3.2% |
| 250 | 18.0% | 3.58 | 11.9% | 32% | 3.2% |
| 325 | 22.0% | 3.54 | 10.6% | 30% | −3.2% |

The above results show that, when fractions that boil at temperatures of no more than 180° C., or no more than 250° C., or no more than 325° C., are removed from the heavy oil, there is provided a heavy oil having improved solubility of asphaltenes, as shown by the increase in the p-value by over 10%, while the aromaticity of the heavy oil remains at acceptable levels.

Example 2

A heavy oil was distilled or flashed to remove a 250° C.$^-$ fraction. The inlet temperature at the distillation or fractionation column was 273° C. The 250° C.$^+$ heavy oil fraction then was treated thermally by heating to temperatures of 390° C., 400° C., 410° C., and 420° C. for a period of time of 6 minutes. This oil then was subjected to cavitation by passing the oil through a cavitation nozzle having a length of 1 inch and a diameter of 0.008 inch.

After the 250° C.$^+$ heavy oil fraction was subjected to cavitation, it was recombined with the 250° C.$^-$ fraction.

A second heavy oil sample then was subjected to a thermal treatment and hydrodynamic cavitation as hereinabove described, to reduce the density and viscosity of the heavy oil, but a lower-boiling 250° C. fraction was not removed from this heavy oil sample prior to subjecting the heavy oil to the thermal treatment and hydrodynamic cavitation.

Figure 2:
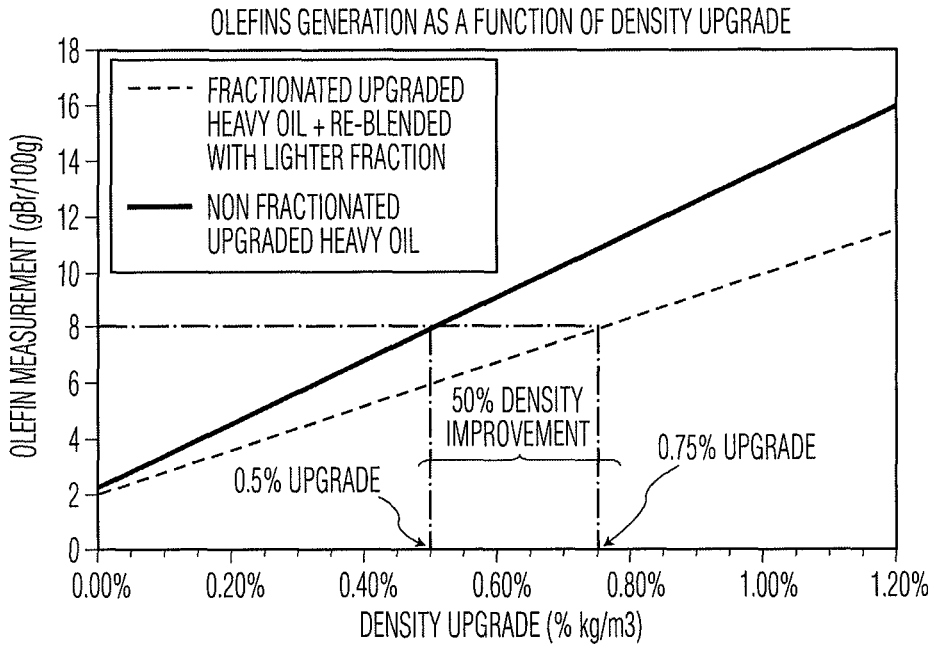
FIG. 2 is a graph showing density upgrade (% kg/m$^3$) versus olefin measurement (g$Br_2$/100 g) of an upgraded heavy oil that was fractionated to remove a 250° C.$^-$ fraction prior to upgrading, followed by reblending with the 250° C.$^-$ fraction, compared to a non-fractionated upgraded heavy oil.
Figure 3:
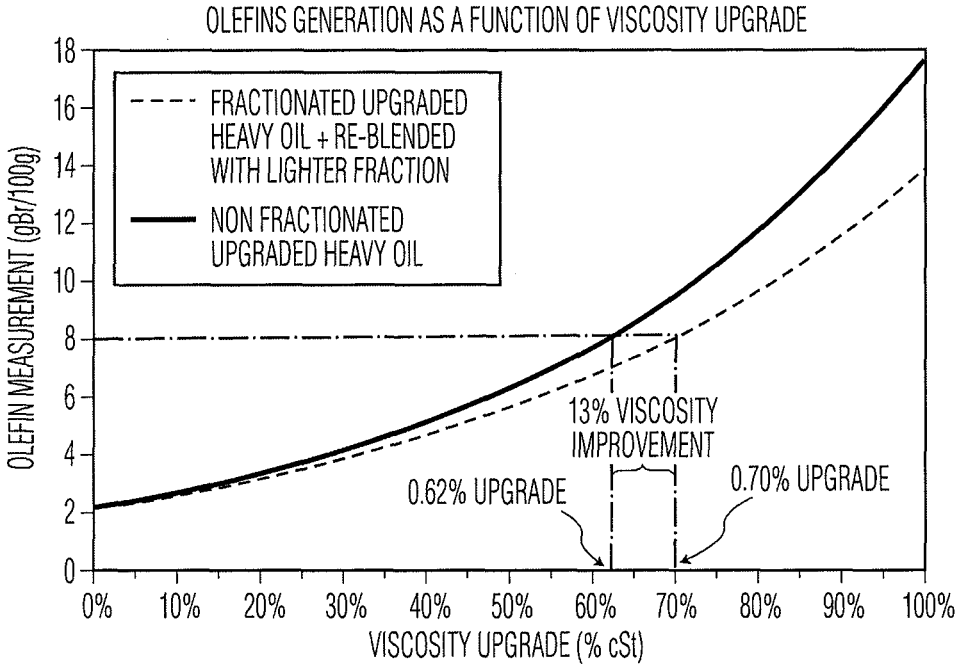
FIG. 3 is a graph showing viscosity upgrade (% cSt) versus olefin measurement (g$Br_2$/100 g) of an upgraded heavy oil that was fractionated to remove a 250° C.$^-$ fraction prior to upgrading, followed by reblending with the 250° C.$^-$ fraction, compared to a non-fractionated upgraded heavy oil.

FIGS. 2 and 3 show the olefin content (measured in terms of the bromine number as $gBr_2/100$ g) for both samples as a function of density and viscosity upgrades, respectively, for all thermal treatment temperatures. The results show that the removal of the 250° C.$^-$ fraction from the heavy oil, permits greater density and viscosity reduction with respect to a given level of olefins. Conversely, the removal of the 250° C.$^-$ fraction from the heavy oil, prior to the upgrading of the heavy oil, provides a heavy oil with an improved reduced olefin content with respect to a given density reduction and a given viscosity reduction.

Example 3

A heavy oil was distilled or flashed to remove a 180° C.$^-$ fraction. The inlet temperature at the distillation or fractionation column was 205° C. The 180° C.$^+$ heavy oil fraction then was treated thermally by heating to temperatures of 390° C., 400° C., 410° C., and 420° C. for a period of time of 6 minutes. This oil then was subjected to hydrodynamic cavitation by passing the oil through a cavitation nozzle having a length of 1 inch and a diameter of 0.008 inch. After the 180° C.$^+$ heavy oil fraction was subjected to cavitation, thereby providing a heavy oil with reduced density and viscosity, it was recombined with the 180° C.$^-$ fraction.

A second heavy oil sample then was subjected to a thermal treatment and hydrodynamic cavitation as hereinabove described to reduce the density and viscosity of the heavy oil, but a lower-boiling 180° C.$^-$ fraction was not removed from the heavy oil sample prior to subjecting the heavy oil to the thermal treatment and hydrodynamic cavitation.

FIG. 4 shows the olefin content (measured in terms of the bromine number as $gBr_2/100$ g) for both samples as a function of density reduction for all thermal treatment temperatures. The results show that the removal of the 180° C.$^-$ fraction from the heavy oil, prior to the upgrading of the heavy oil, permits a greater density reduction with respect to a given level of olefins. Conversely, the removal of the 180° C.$^-$ fraction from the heavy oil, prior to the upgrading of the heavy oil, provides a heavy oil with an improved reduced olefin content with respect to a given density reduction.

Example 4

A heavy oil was distilled or flashed to remove a 325° C.$^-$ fraction. The inlet temperature at the distillation or fractionation column was 345° C. The 325° C.$^+$ heavy oil fraction was treated thermally by heating to temperatures of 390° C., 400° C., 410° C., and 420° C. for a period of time of 6 minutes. This oil then was subjected to hydrodynamic cavitation by passing the oil through a cavitation nozzle having a length of 1 inch and a diameter of 0.008 inch.

After the 325° C.$^+$ heavy oil fraction was subjected to cavitation, thereby providing a heavy oil having a reduced density and viscosity, it was recombined with the 325° C.$^-$ fraction.

A second heavy oil sample then was subjected to a thermal treatment and hydrodynamic cavitation as hereinabove described to reduce the density and viscosity of the heavy oil, but a lower-boiling 325° C.$^-$ fraction was not removed from the heavy oil prior to subjecting the heavy oil to the thermal treatment and hydrodynamic cavitation.

FIG. 5 shows the olefin content (measured in terms of the bromine number as $gBr_2$/100 g) for both samples as a function of density upgrades for all thermal treatment temperatures. The results shows that the removal of the 325° C.$^-$ fraction from the heavy oil, prior to the upgrading of the heavy oil, permits a greater density reduction with respect to a given level of olefins. Conversely, the removal of the 325° C.$^-$ fraction from the heavy oil, prior to the upgrading of the heavy oils, provides a heavy oil with an improved reduced olefin content with respect to a given density reduction.

The disclosures of all patents and publications, including published patent applications, are herein incorporated by reference to the same extent as if each patent and publication were incorporated individually by reference.

It is to be understood, however, that the scope of the present invention is not to be limited to the specific embodiments described above. The invention may be practiced other than as particularly described and still be within the scope of the accompanying claims.

What is claimed is:

1. A process for treating a heavy oil to provide a treated heavy oil having a reduced density and viscosity, and an olefin content that does not exceed 1.0 wt. %, comprising:

(a) separating an initial heavy oil into a first fraction, said first fraction having a boiling range that does not exceed 180° C. and a second fraction, wherein said second fraction comprises a heavy oil having a p-value of at least 5% greater than the p-value of said initial heavy oil prior to separating said initial heavy oil into said first fraction and said second fraction, and said second fraction has an aromaticity that is no more than 5% less than the aromaticity of said initial heavy oil prior to separating said initial heavy oil into said first fraction and said second fraction;

(b) reducing the density and viscosity of said second fraction; and (c) combining said second fraction with at least a portion of said first fraction to provide a treated heavy oil having an olefin content that does not exceed 1.0 wt. %.

2. The process of claim 1 wherein said first fraction has a boiling range that does not exceed 150° C.

3. The process of claim 1 wherein said second fraction has a p-value which is at least 10% greater than the p-value of said initial heavy oil prior to separating said initial heavy oil into said first fraction and said second fraction.

4. The process of claim 3 wherein said second fraction has a p-value which is at least 15% greater than the p-value of said initial heavy oil prior to separating said initial heavy oil into said first fraction and said second fraction.

5. The process of claim 4 wherein said second fraction has a p-value which is at least 25% greater than the p-value of said initial heavy oil prior to separating said initial heavy oil into said first fraction and said second fraction.

6. The process of claim 1 wherein said second fraction has an aromaticity that is no more than 3% less of the aromaticity of said initial heavy oil prior to separating said initial heavy oil into said first fraction and said second fraction.

7. The process of claim 6 wherein said second fraction has an aromaticity that is at least 3% greater than the aromaticity of said initial heavy oil prior to separation of initial said heavy oil into said first fraction and said second fraction.

8. The process of claim 7 wherein said second fraction has an aromaticity that is at least 5% greater than the aromaticity of said initial heavy oil prior to separation of said initial heavy oil into said first fraction and said second fraction.

9. The method of claim 1 wherein the density and viscosity of said second fraction are reduced by heating said second fraction to a temperature of from about 200° C. to about 600° C.

10. The method of claim 9 wherein the density and viscosity of said second fraction are reduced by heating said second fraction to a temperature of from about 350° C. to about 450° C.

11. The method of claim 10 wherein the density and viscosity of said second fraction are reduced by heating said second fraction to a temperature of from about 380° C. to about 420° C.

12. The method of claim 9 where said second fraction is heated for a period of time of from about 1 minute to about 20 minutes.

13. The method of claim 12 wherein said second fraction is heated for a period of time of from about 3 minutes to about 8 minutes.

14. The method of claim 1 wherein the density and viscosity of said second fraction are reduced by subjecting said second fraction to cavitation.

15. The method of claim 14 wherein said second fraction is subjected to hydrodynamic cavitation.

16. The method of claim 15 wherein said second fraction is subjected to hydrodynamic cavitation by passing said second fraction from a conduit through a cavitation zone, wherein the ratio of the width of said cavitation zone to the width of said conduit is from about $1/230$ to $1/75$.

17. The method of claim 16 wherein the ratio of the length of the cavitation zone to the width of the cavitation zone is from about 10 to about 125.

18. The method of claim 17 wherein the ratio of the length of the cavitation zone to the width of the cavitation zone is from about 50 to about 125.

19. The method of claim 1 wherein the density and viscosity of said second fraction are reduced by heating said second fraction to a temperature of from about 200° C. to about 600° C., and then subjecting said second fraction to cavitation.

20. The method of claim 19 wherein said second fraction is heated to a temperature of from about 350° C. to about 450° C.

21. The method of claim 20 wherein said second fraction is heated to a temperature of from about 380° C. to about 420° C.

22. The method of claim 19 wherein said second fraction is subjected to hydrodynamic cavitation.

23. The method of claim 22 wherein said second fraction is subjected to hydrodynamic cavitation by passing said second fraction from a conduit through a cavitation zone, wherein the ratio of the width of said cavitation zone to the width of said conduit is from about 1/230 to 1/75.

24. The method of claim 23 wherein the ratio of the length of the cavitation zone to the width of the cavitation zone is from about 10 to about 125.

25. The method of claim 24 wherein the ratio of the length of the cavitation zone to the width of the cavitation zone is from about 50 to about 125.

26. The method of claim 1 wherein the density and viscosity of said second fraction are reduced by subjecting said second fraction to a hydrogen addition process.

27. A process for treating a heavy oil to provide a treated heavy oil having a reduced density and viscosity, and an olefin content that does not exceed 1.0 wt. %, comprising:

(a) separating an initial heavy oil into a first fraction and a second fraction, wherein said second fraction comprises a heavy oil having a p-value of at least 5% greater than the p-value of said initial heavy oil prior to separating said initial heavy oil into said first fraction and said second fraction, and said second fraction has an aromaticity that is no more than 5% less than the aromaticity of said initial heavy oil prior to separating said initial heavy oil into said first fraction and said second fraction;

(b) subjecting, without the addition of external gas, said second fraction to cavitation, thereby reducing the density and viscosity of said second fraction; and (c) combining said second fraction with at least a portion of said first fraction to provide a treated heavy oil having an olefin content that does not exceed 1.0 wt. %.

28. The process of claim 27 wherein said first fraction has a boiling range that does not exceed 450° C.

29. The process of claim 28 wherein said first fraction has a boiling range that does not exceed 325° C.

30. The process of claim 29 wherein said first fraction has a boiling range that does not exceed 250° C.

31. The process of claim 29 wherein said first fraction has a boiling range that does not exceed 180° C.

32. The process of claim 31 wherein said first fraction has a boiling range that does not exceed 150° C.

33. The process of claim 27 wherein said second fraction has a p-value which is at least 10% greater than the p-value of said initial heavy oil prior to separating said initial heavy oil into said first fraction and said second fraction.

34. The process of claim 33 wherein said second fraction has a p-value which is at least 15% greater than the p-value of said initial heavy oil prior to separating said initial heavy oil into said first fraction and said second fraction.

35. The process of claim 34 wherein said second fraction has a p-value which is at least 25% greater than the p-value of said initial heavy oil prior to separating said initial heavy oil into said first fraction and said second fraction.

36. The process of claim 27 wherein said second fraction has an aromaticity that is no more than 3% less of the aromaticity of said initial heavy oil prior to separating said initial heavy oil into said first fraction and said second fraction.

37. The process of claim 36 wherein said second fraction has an aromaticity that is at least 3% greater than the aromaticity of said initial heavy oil prior to separation of initial said heavy oil into said first fraction and said second fraction.

38. The process of claim 37 wherein said second fraction has an aromaticity that is at least 5% greater than the aromaticity of said initial heavy oil prior to separation of said initial heavy oil into said first fraction and said second fraction.

39. The process of claim 27 wherein, subsequent to step (a), and prior to subjecting said second fraction to cavitation, said second fraction is heated to a temperature of from about 200° C. to about 600° C.

40. The method of claim 39 wherein said second fraction is heated to a temperature of from about 350° C. to about 450° C.

41. The method of claim 40 wherein said second fraction is heated to a temperature of from about 380° C. to about 420° C.

42. The method of claim 39 where said second fraction is heated for a period of time of from about 1 minute to about 20 minutes.

43. The method of claim 42 wherein said second fraction is heated for a period of time of from about 3 minutes to about 8 minutes.

44. The method of claim 27 wherein said cavitation is hydrodynamic cavitation.

45. The method of claim 44 wherein said second fraction is subjected to hydrodynamic cavitation by passing said second fraction from a conduit through a cavitation zone, wherein the ratio of the width of said cavitation zone to the width of said conduit is from about 1/230 to 1/75.

46. The method of claim 45 wherein the ratio of the length of the cavitation zone to the width of the cavitation zone is from about 10 to about 125.

47. The method of claim 46 wherein the ratio of the length of the cavitation zone to the width of the cavitation zone is from about 50 to about 125.

48. A process for treating a heavy oil to provide a treated heavy oil having a reduced density and viscosity, and an olefin content that does not exceed 1.0 wt. %, comprising:

(a) separating an initial heavy oil into a first fraction and a second fraction wherein said second fraction comprises a heavy oil having a p-value of at least 5% greater than the p-value of said initial heavy oil prior to separating said initial heavy oil into said first fraction and said second fraction, and said second fraction has an aromaticity that is no more than 5% less than the aromaticity of said initial heavy oil prior to separating said initial heavy oil to said first fraction and said second fraction;

(b) heating said second fraction to a temperature of from about 200° C. to about 600° C., and then subjecting, without the addition of external gas, said second fraction to cavitation, thereby reducing the density and viscosity of said second fraction; and (c) combining said second fraction with at least a portion of said first fraction to provide a treated heavy oil having an olefin content that does not exceed 1.0 wt. %.

49. The process of claim 48 wherein said first fraction has a boiling range that does not exceed 450° C.

50. The process of claim 49 wherein said first fraction has a boiling range that does not exceed 325° C.

51. The process of claim 50 wherein said first fraction has a boiling range that does not exceed 250° C.

52. The process of claim 51 wherein said first fraction has a boiling range that does not exceed 180° C.

53. The process of claim 52 wherein said first fraction has a boiling range that does not exceed 150° C.

54. The process of claim 48 wherein said second fraction has a p-value which is at least 10% greater than the p-value of said initial heavy oil prior to separating said initial heavy oil into said first fraction and said second fraction.

55. The process of claim 54 wherein said second fraction has a p-value which is at least 15% greater than the p-value of said initial heavy oil prior to separating said initial heavy oil into said first fraction and said second fraction.

56. The process of claim 55 wherein said second fraction has a p-value which is at least 25% greater than the p-value of said initial heavy oil prior to separating said initial heavy oil into said first fraction and said second fraction.

57. The process of claim 48 wherein said second fraction has an aromaticity that is no more than 3% less of the aromaticity of said initial heavy oil prior to separating said initial heavy oil into said first fraction and said second fraction.

58. The process of claim 57 wherein said second fraction has an aromaticity that is at least 3% greater than the aromaticity of said initial heavy oil prior to separation of initial said heavy oil into said first fraction and said second fraction.

59. The process of claim 58 wherein said second fraction has an aromaticity that is at least 5% greater than the aromaticity of said initial heavy oil prior to separation of said initial heavy oil into said first fraction and said second fraction.

60. The method of claim 48 wherein said second fraction is heated to a temperature of from about 350° C. to about 450° C.

61. The method of claim 60 wherein said second fraction is heated to a temperature of from about 380° C. to about 420° C.

62. The method of claim 48 where said second fraction is heated for a period of time of from about 1 minute to about 20 minutes.

63. The method of claim 62 wherein said second fraction is heated for a period of time of from about 3 minutes to about 8 minutes.

64. The method of claim 48 wherein said cavitation is hydrodynamic cavitation.

65. The method of claim 64 wherein said second fraction is subjected to hydrodynamic cavitation by passing said second fraction from a conduit through a cavitation zone, wherein the ratio of the width of said cavitation zone to the width of said conduit is from about $1/230$ to $1/75$.

66. The method of claim 65 wherein the ratio of the length of the cavitation zone to the width of the cavitation zone is from about 10 to about 125.

67. The method of claim 66 wherein the ratio of the length of the cavitation zone to the width of the cavitation zone is from about 50 to about 125.

* * * * *